US006116651A

United States Patent [19]

Makofsky et al.

[11] Patent Number: 6,116,651

[45] Date of Patent: Sep. 12, 2000

[54] EXPANABLE FOLDER

[75] Inventors: Marvin A. Makofsky, Sand Point; Jerome B. Schwartz, Mineola, both of N.Y.

[73] Assignee: Pama Enterprises, New York, N.Y.

[21] Appl. No.: 09/506,242

[22] Filed: Feb. 17, 2000

[51] Int. Cl.[7] ..... B42D 3/00

[52] U.S. Cl. ..... 281/29; 281/31; 281/37; 281/45; 402/70; 402/73

[58] Field of Search ..... 281/29, 31, 37, 281/45, 51; 402/70, 73, 4; 493/947; 40/359; 206/425

[56] References Cited

U.S. PATENT DOCUMENTS 4,991,767 2/1991 Wyant ..... 281/31 X 5,025,978 6/1991 Pacione ..... 281/29

5,174,606 12/1992 Hune ..... 281/45

5,904,374 5/1999 Lee ..... 281/29

*Primary Examiner*—Willmon Fridie, Jr.

*Attorney, Agent, or Firm*—Francis C. Hand, Esq.; Carella Byren Bain Gilfillan Cecchi Stewart & Olstein

[57] ABSTRACT

The folder is made with a pair of sections, each of which is provided with an inside panel to form a pocket. The inside panel and the front panel of each section of the folder is provided with vertical and horizontal score lines adjacent the respective edges of the folder to permit expansion of the pockets when filled with paper or the like. The folder is also provided with a pair of score lines on opposite sides of the vertical fold line to allow the folder to triangulate along the vertical fold line when the folder is filled to capacity. When filled to capacity, the folder retains a flat appearance.

10 Claims, 3 Drawing Sheets

EXPANABLE FOLDER

This invention relates to an expandable folder.

As is known, various types of folders have been constructed for the holding of sheets of paper and the like. One conventional folder is constructed with a pair of sections which are foldable along a vertical fold line to overlie from each other. In addition, each section is constructed with a pocket for receiving sheets of papers and the like. However, because of the nature of the construction of the folder sections, the pocket in each section has a rather limited capacity. Further, if the capacity of the pocket is exceeded, for example by overstuffing the pocket with more sheets than for which the pocket is designed, there is a risk that the pocket may tear along the edge or that the sheets of paper may slide out of the pocket.

When a conventional folder is used and the capacity of the pockets are exceeded, the result makes for an undesirable container and the recipient will most likely remove the contents and dispose of the folder. Therefore, the messages contained on the folder, which may be instructional as well as promotional, are lost forever.

Further, the folders generally having a limited capacity as the folder sections adjacent to the vertical fold line have a resistance to folding to accommodate an increased thickness of the materials inserted into the pockets.

Accordingly, it is an object of this invention to provide an expandable folder which has an increased capacity.

It is another object of the invention to provide an expandable folder which can be filled to capacity while retaining a flat appearance when closed.

Briefly, the invention provides an expandable folder which is comprised of a pair of sections which have a fold line therebetween for folding of the sections into overlying relation to each other. Each section includes a front panel of rectangular shape and an inside panel secured to the front panel to define a pocket.

In accordance with the invention, the front panel has a horizontally disposed score line spaced from each of a bottom edge and a top edge thereof and a pair of vertically disposed score lines spaced from each side thereof. In addition, the front panel has a plurality of angularly disposed score lines each extending from an intersection of a respective horizontally disposed score line and a vertically disposed score line to a corner of the panel.

In addition, the inside panel has a horizontally disposed score line spaced from the bottom edge, a vertically disposed score line spaced from a side edge and an angularly disposed score line extending from an intersection of the horizontally disposed score line and the vertically disposed score line to a corner of the inside panel.

The placement of the score lines in each of the panels of each section of the folder is such as to permit the panels to expand away from each other in order to enlarge the thickness of the pocket and thus the capacity of the pocket upon the insertion of materials, such as a stack of papers, into the pocket.

The pocket forming inside panel is formed of a side flap which extends from and which is folded over the front panel along a vertical fold line and a bottom flap which extends from and which is folded over the front panel along a horizontal fold line. The bottom flap is also secured over the side flap, for example, by an adhesive or other suitable securing means.

When the folder is placed in use, each pocket may be filled to capacity with sheets of paper, for example of 8 ½ inch by 11 inch size or any other size or may be filled with magazines or other similar types of materials.

When each pocket is being filled, the score lines in the panels at the two edges at which the inside panel is secured to the front panel, allow the panels to expand with the two edges becoming triangulated. By "triangulated" is meant that as the panels move away from each other, the edge portions between a vertical score line and the adjacent vertical fold line and the edge portions between a horizontal score line and a horizontal fold line pivot inwardly thereby allowing the side and bottom of the pocket to expand while the side edge and bottom edge take on the triangular shape. For example, the triangular shape is designed to be that of an equilateral triangular when the pocket is filled to the designed capacity. In this respect, the capacity of the pocket is designed to be the width of an edge portion between a score line and a fold line.

The folder is also provided with vertical score lines adjacent to and spaced from the vertical fold line. Thus, after a folder has been filled and closed, the folder also triangulates along the spine or vertical fold line of the folder thereby maintaining the flat appearance of the closed folder.

The folder may be made of a single blank on automated equipment. To this end, the blank may be prescored with the various score lines and fold lines.

The expandable folder works equally as well with one sheet enclosed as when filled to capacity. This feature permits the use of one folder and avoids the necessity for the users to have multiple sizes of folders on hand for the variety of needs that they may encounter.

These and other objects and advantages of the invention will become more apparent from the following detailed description taken in conjunction with the accompanying drawings wherein.

Figure 4:
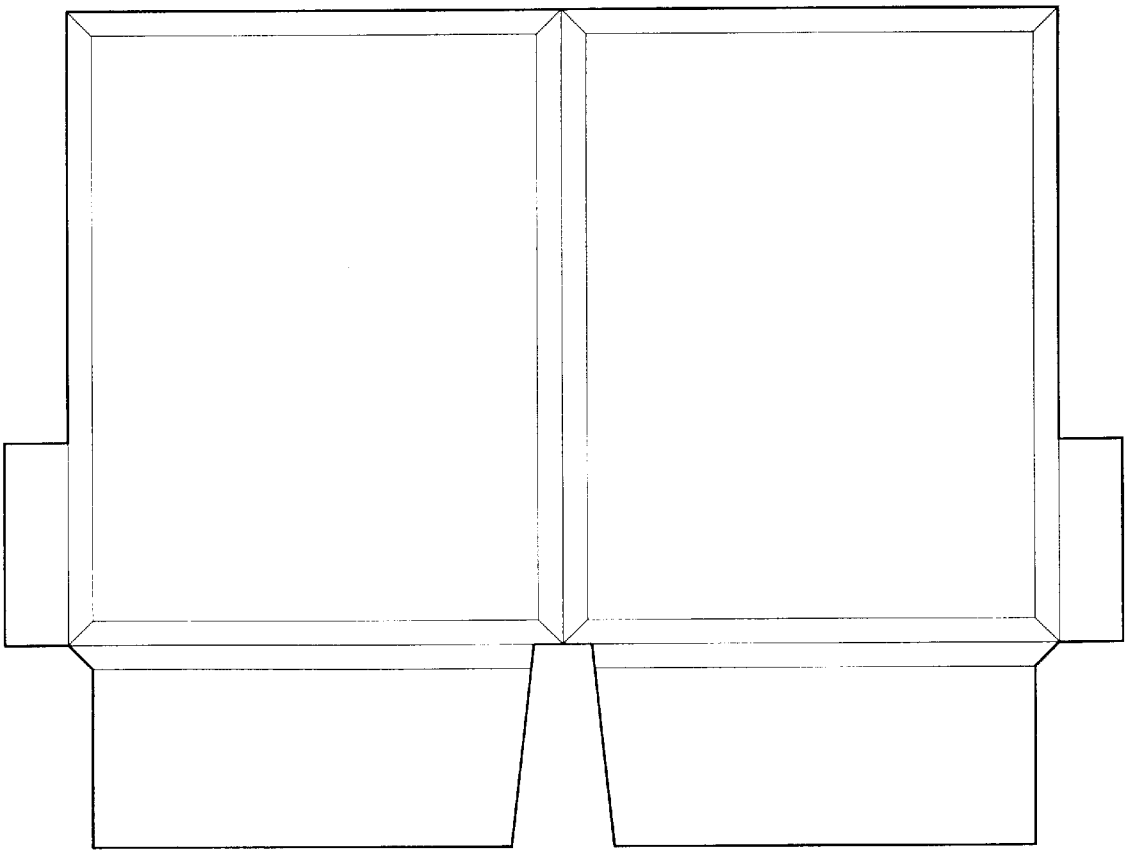
FIG. 4 illustrates a blank for making the folder of FIG. 1.

Referring to FIG. 4, the blank 10 for making an expandable folder is formed of two sections 11 of mirror-image construction which are foldable along a vertical fold line 12. The blank 10 is made of cardboard or any other suitable material.

Each section 11 includes a front panel 13, a side flap 14 which extends from a side of the front panel 13 along a vertical fold line 15 and a bottom flap 16 which extends from the bottom of the panel 13 along a horizontal fold line 17.

The front panel 13 is of a rectangular shape and is of a conventional size to fit the intended contents. In addition, the front panel 13 has a rectangular frame of score lines including a horizontally disposed score line 18 spaced from the bottom edge of the panel 13 as defined by the horizontal fold line 17, a horizontal score line 19 spaced from the top edge and a pair of vertically disposed score lines 20, 21 spaced from the vertical edges of the panel 13. In addition, an angularly disposed score lines 22 extend from an intersection of each horizontal score line with a vertical score line to a corner of the panel 13.

The side flap 14 is of rectangular shape with a height which is minor fraction of the height of the front panel 13 and of a width to extend to a point spaced inwardly of the vertical score line 20 of the front panel 13. The side flap 14 also has a vertical score line 23 spaced from the vertical fold line 15 a distance equal to the spacing of the vertical score line 20 from the fold line 15 so as to be coincident with the score line 20 when the side flap 14 is folded over the panel 13.

The bottom flap 16 has a trapezoidal section 24 which extends from the front panel 13 and a rectangular section 25 which extends from the trapezoidal section 24. The two sections are separated by a score line 26 parallel to the fold line 17 and spaced therefrom a distance equal to the spacing of the score line 18 from the fold line 17 so as to be coincident therewith. The rectangular section 25 has a vertical edge 27 at one side which is aligned with the score line 20 on the front panel 13 for purposes as described below. The opposite edge 28 is tapered in a conventional manner to facilitate entry into a pocket to be defined by the flaps 14, 16 and the front panel 13.

Figure 3:
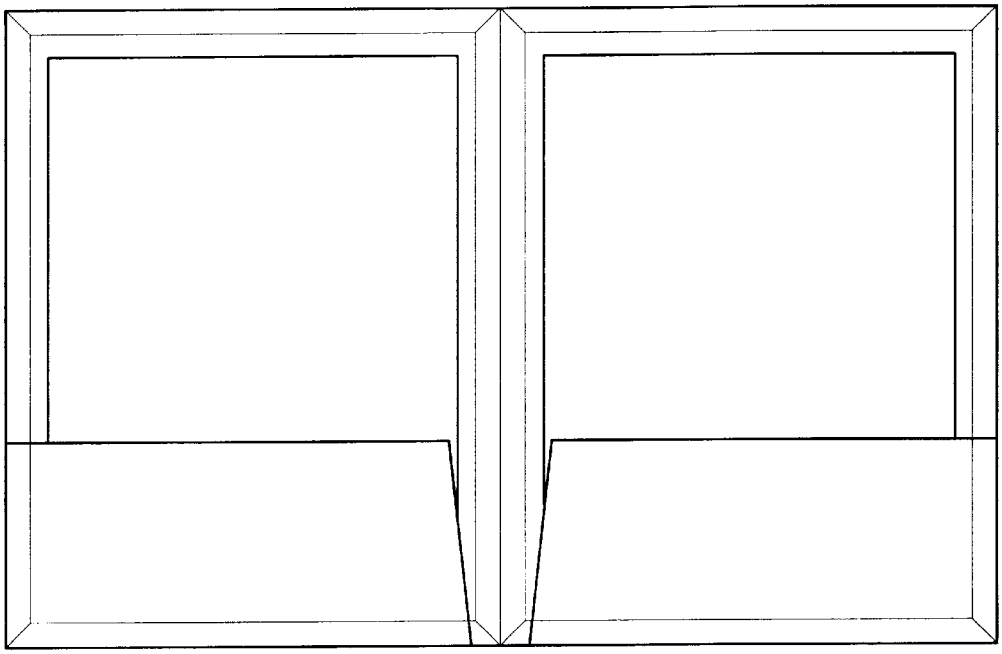
FIG. 3 illustrates a front view of the folder of FIG. 1 in an opened condition.

The blank 10 is foldable in a manner so as to produce a folder as illustrated in FIG. 3. In this respect, the blank 10 may be folded and glued on automated equipment. For example, a supply of blanks 10 may be provided to a folding station wherein the side flaps 14 of the blanks 10 are each folded over the respective fold lines 15 into overlying relation with the front panels 13.

Next, the blank 10 is processed in a gluing station in which glue or an adhesive is provided on the exposed face of each side flap 14 between the score line 23 and the free edge of the side flap 14.

Thereafter, the blank 10 is forwarded to a second folding station in which the bottom flaps 16 are folded over into overlying relation with the folded-in side flaps 14 and the panels 13 to complete a folder 29. At this time, the bottom flaps 16 are each secured adhesively to the side flaps 14 to form an inside front panel 30 and, thereby, define a pocket between the front panel 13 and inside panel 30. The resulting folder 29 can then be packaged or used in a conventional manner.

When completely folded, the angular end edge of the trapezoidal section 24 of each bottom flap overlies a side flap 14 for a complete seal. Alternatively, each side flap 14 may have an angularly disposed lower edge to abut the angular end edge of the trapezoidal section 24.

The inside panel 30 may be formed in other manners than as illustrated so long as the side and bottom areas are provided with score lines to allow for triangulation at the two edges.

Figure 1:
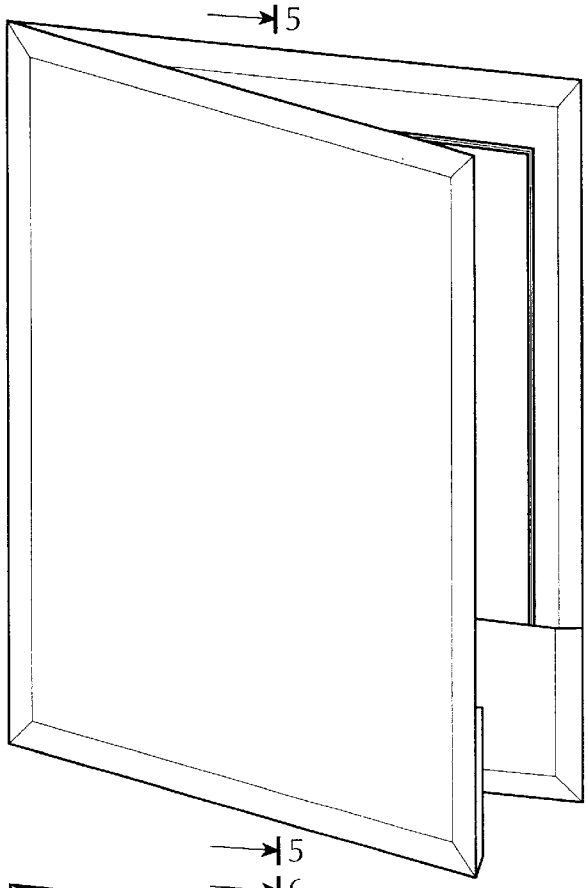
FIG. 1 illustrates a perspective view of a folder constructed in accordance with the invention in a partially filled condition.
Figure 5:
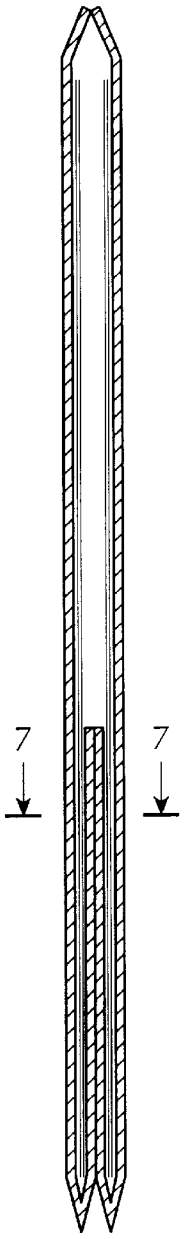
FIG. 5 illustrates a view taken on line 5—5 of the partially filled folder.
Figure 7:
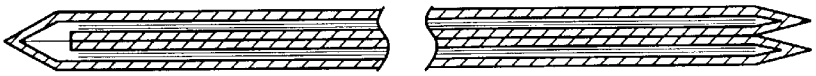
FIG. 7 illustrates a view taken on line 7—7 of FIG. 5.

In use, as indicated in FIGS. 1 and 3, a plurality of sheets of paper 32 may be inserted into the pockets of the folder 30. As the sheets of paper 31 are inserted into the respective pockets, the pockets begin to expand with the front panel 13 and inside panel 30 moving away from each other. During this time, the two edges of the inside panel 30 deform in a triangulated manner as described above. When the folder 29 is closed, the top edges may be manually pinched in as indicated in FIG. 5. The closed folder 29, in either case, maintains a flat appearance as indicated in FIGS. 5 and 7.

Figure 2:
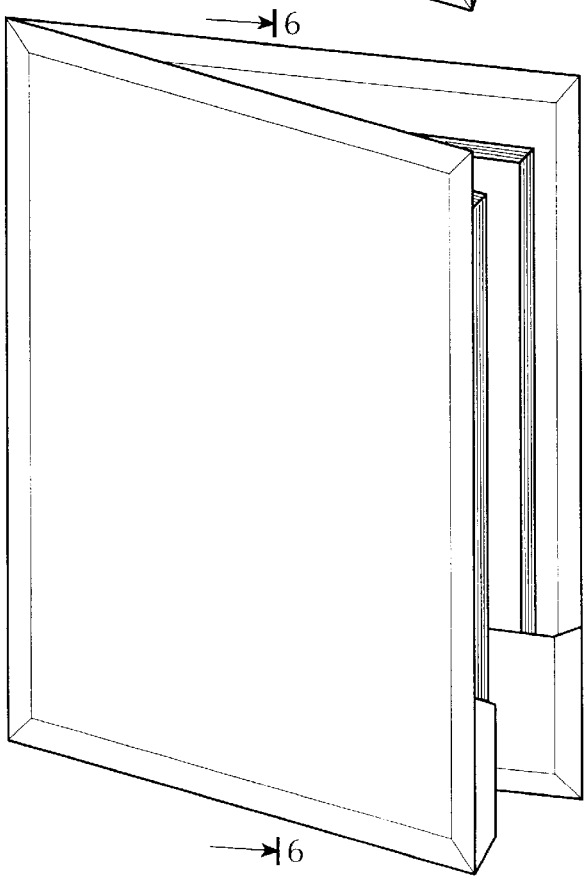
FIG. 2 illustrates a view similar to FIG. 1 with the folder in a filled-to-capacity condition.
Figure 6:
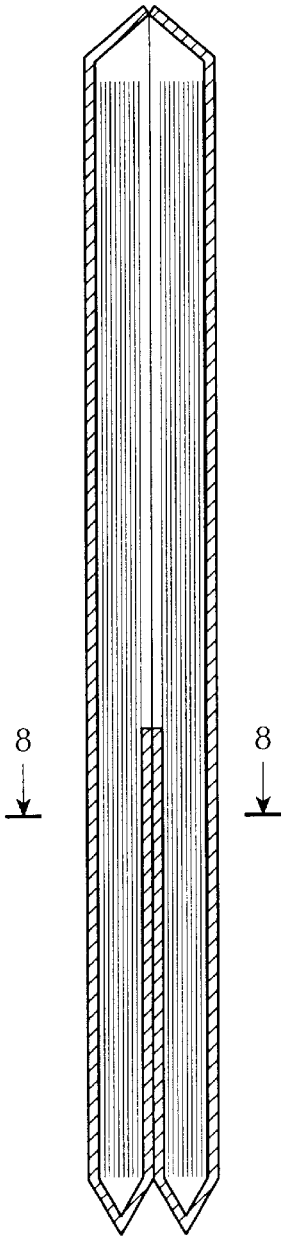
FIG. 6 illustrates a view taken on line 6—6 of FIG. 2 of the completely filled folder.
Figure 8:
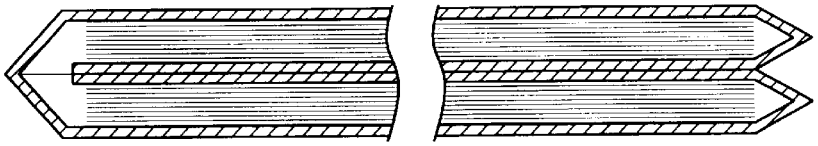
FIG. 8 illustrates a view taken on line 8—8 of FIG. 6.
Figure 1:
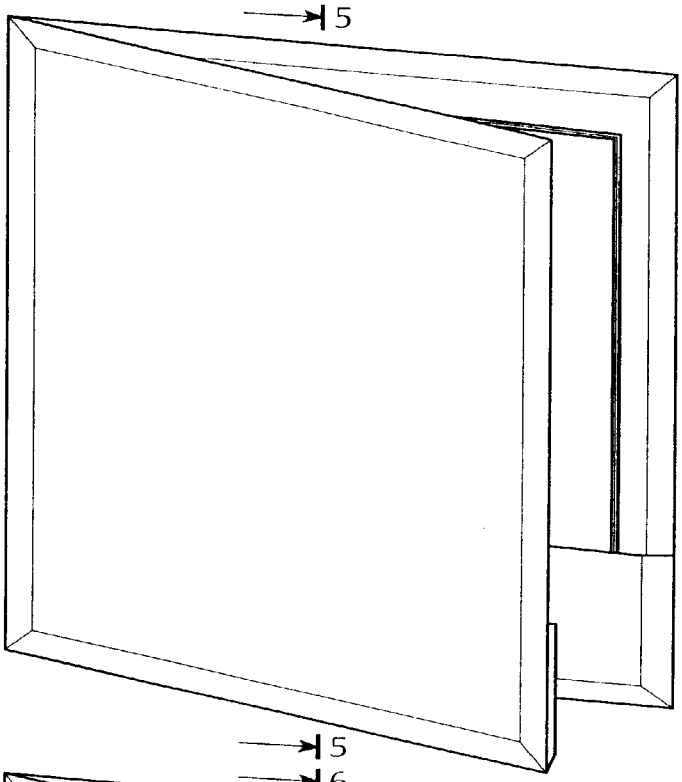
Figure 2:
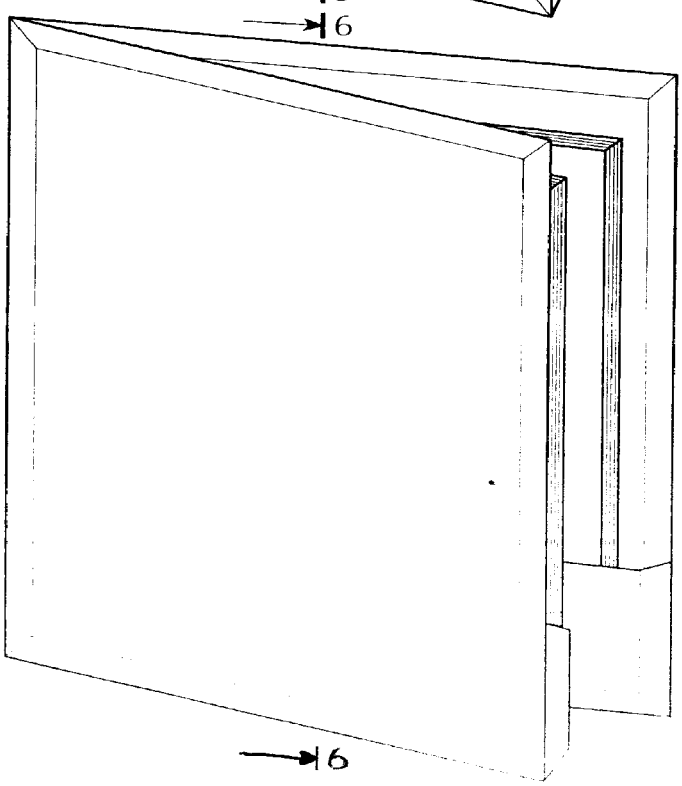
Figure 3:
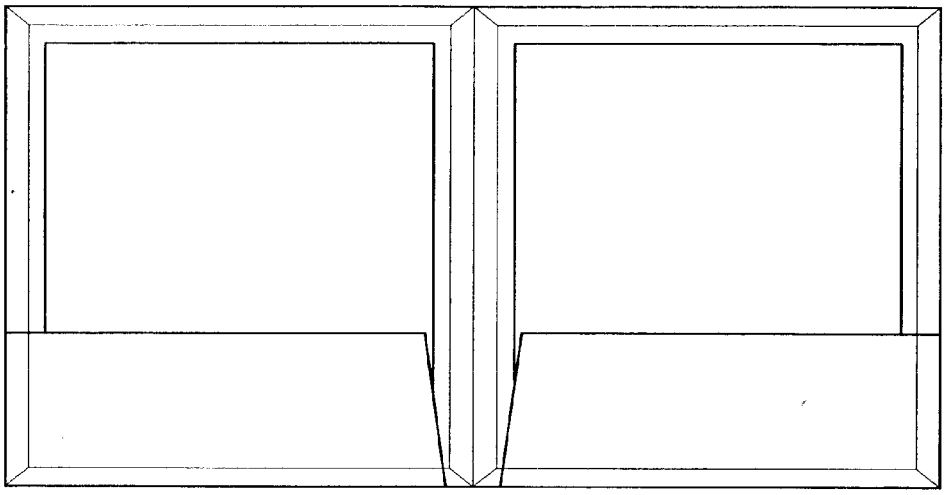
Figure 4:
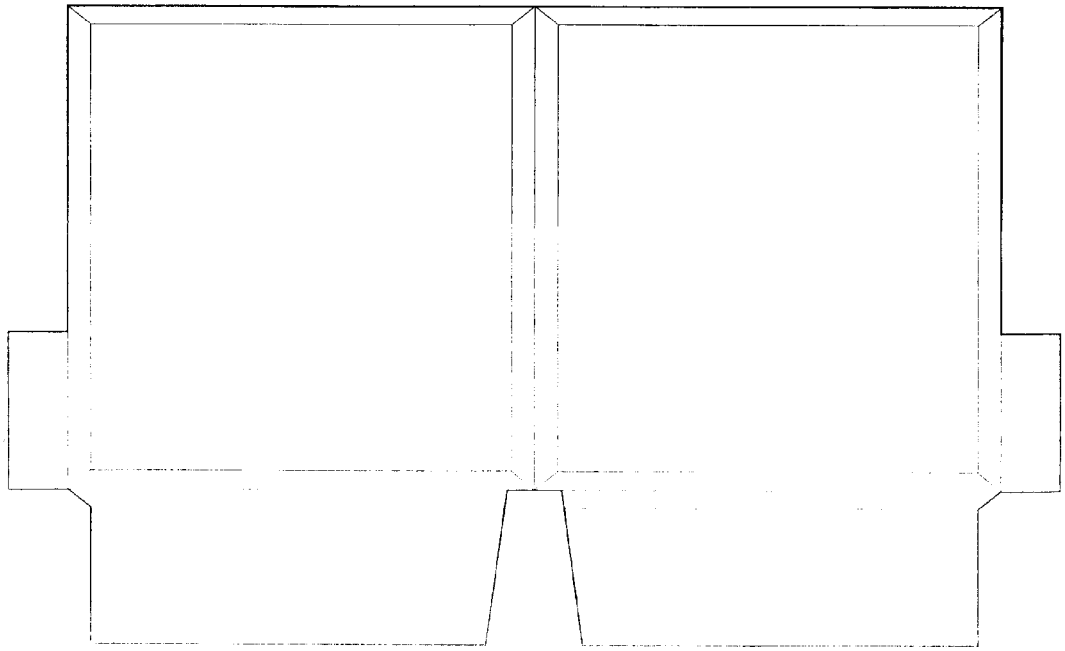
Figure 5:
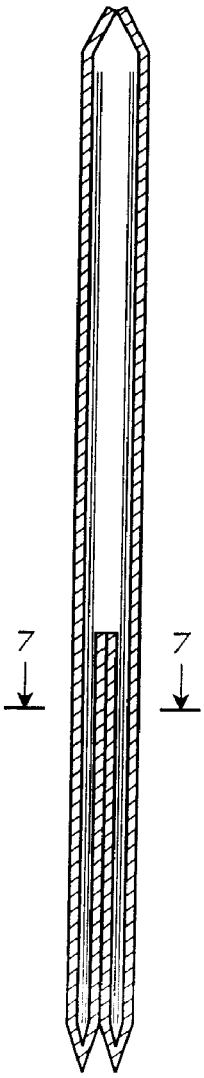
Figure 6:
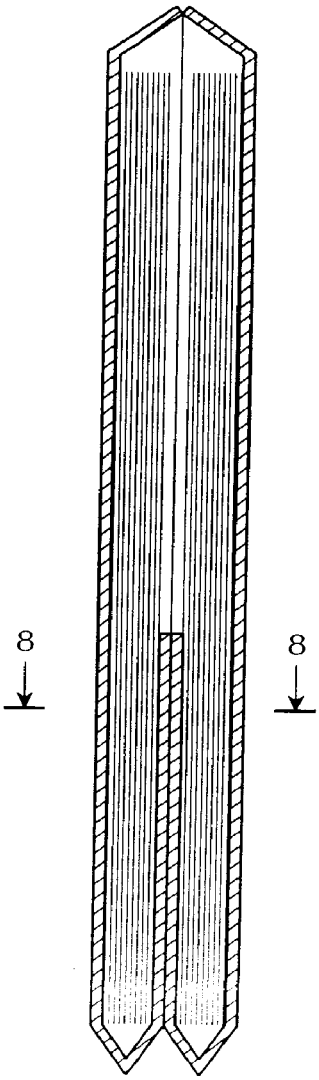
Figure 7:
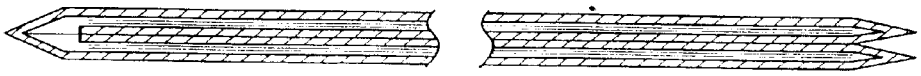
Figure 8:
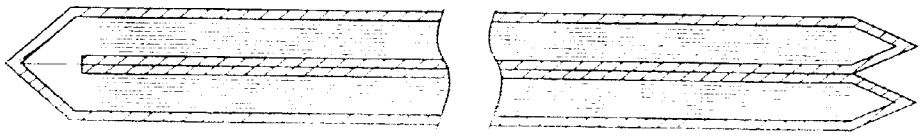
Figure 1:
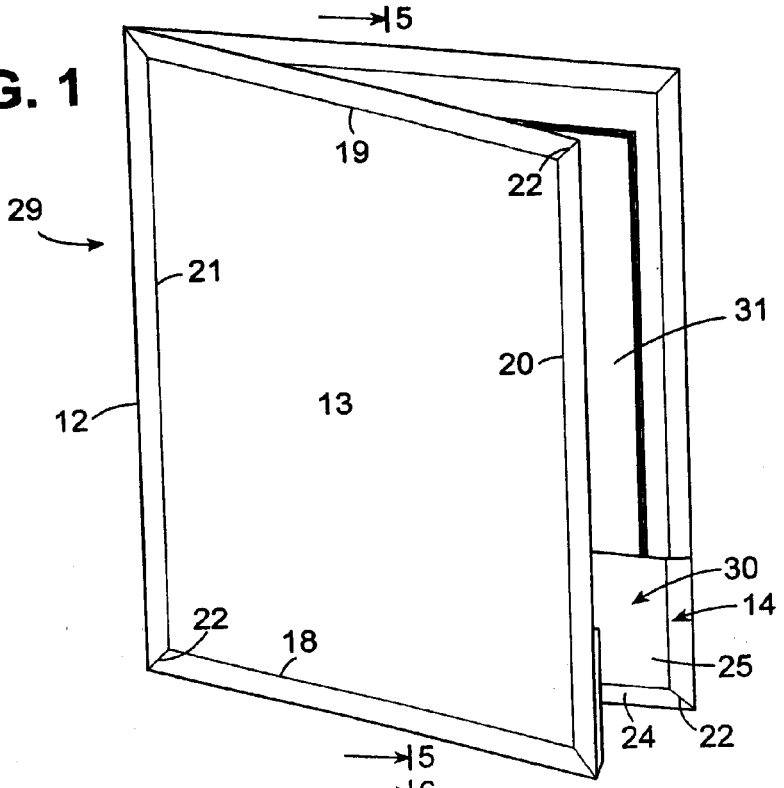
Figure 2:
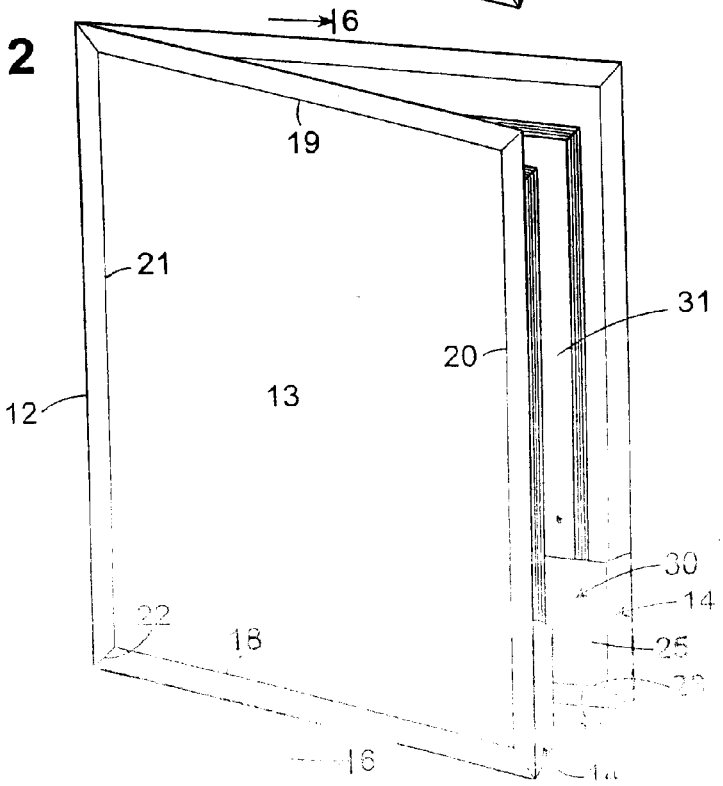
Figure 3:
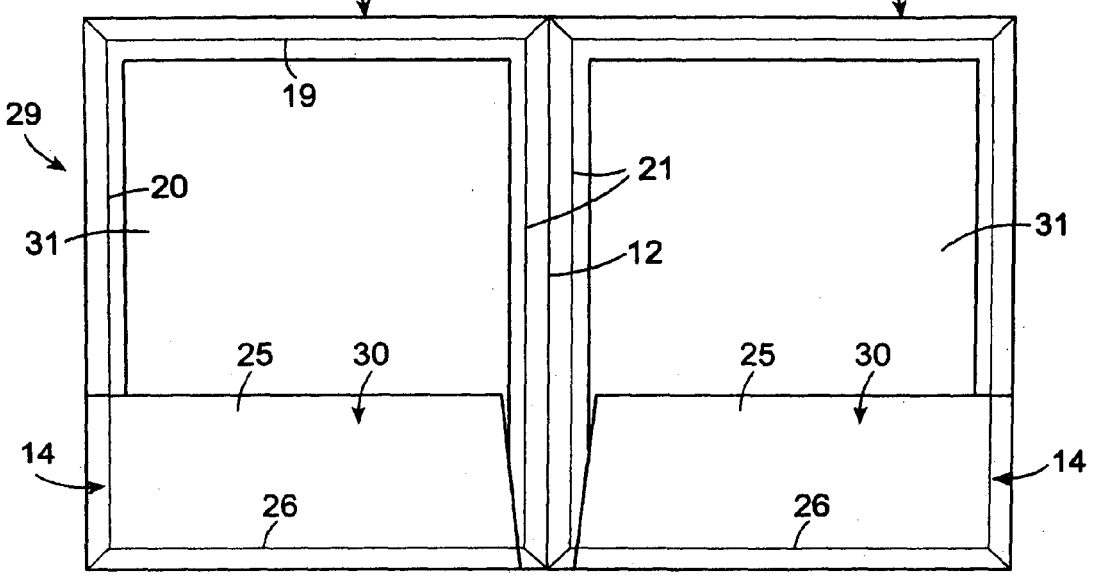
Figure 4:
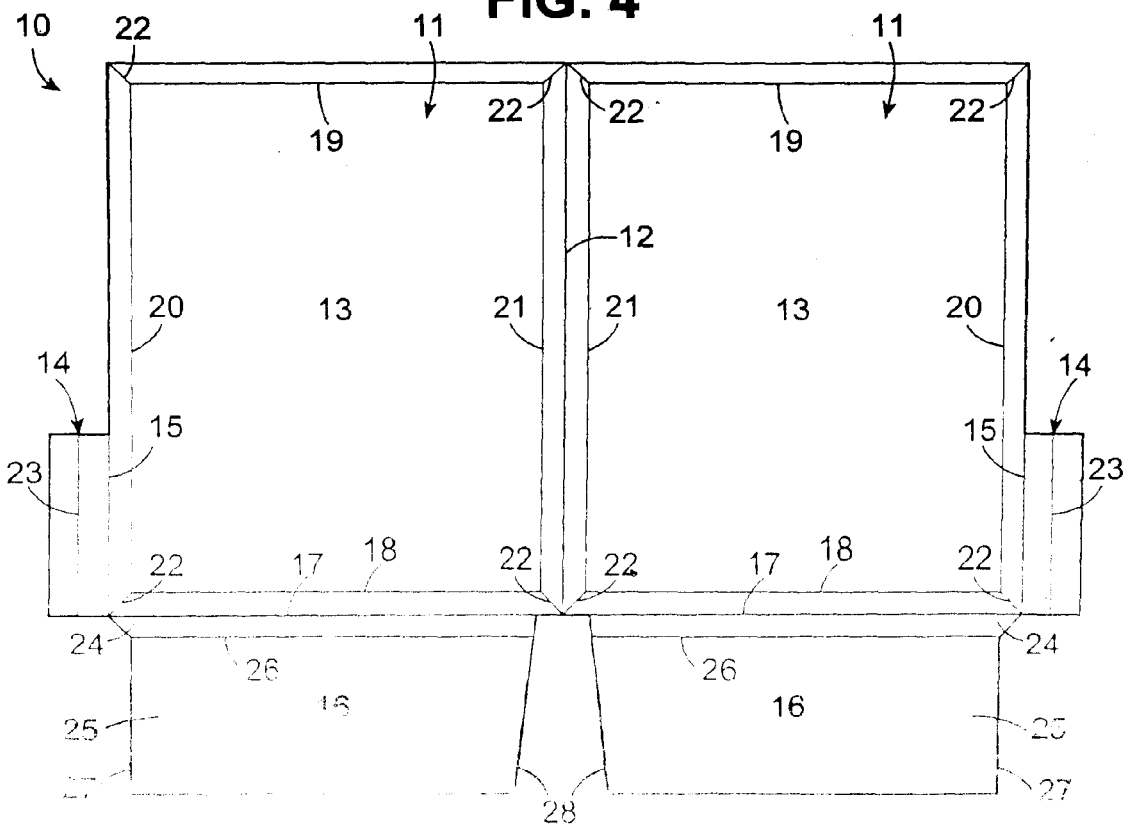

Should the pockets of the folder 29 be filled to capacity, for example as illustrated in FIGS. 2 and 6, with a greater thickness of paper 3, the respective pockets of the folder expand with further triangulation of the two edges of the pocket as indicated in FIG. 6. However, as indicated in FIGS. 6 and 8, the folder retains a flat appearance.

When the folder is closed so that the sections 11 overlie each other, the vertical edges of the sections 11 also triangulate as illustrated in each of FIGS. 5 and 6.

The closed folder 29 may be inserted into an envelope, such as an expandable envelope described in an application entitled "An Expandable Envelope Construction" filed on even date by the same inventors. In this case, the triangulated edges of the envelope serve to pinch in the open sides 19 and the top edges of the folder.

It is to be noted that when the pockets are filled to capacity, for example, to a one-half inch thickness of paper, the bottom edge of the pocket triangulates as indicated in FIG. 6. In addition, the vertical edge of each pocket and the spine of the folder triangulate as indicated in FIG. 8.

The inside panels 30 may also be provided with slits or the like in order to receive business cards, inserts and the like as is conventional.

The folder may also be provided with various graphical elements such as shading or colors on either the marginal edges between the score lines and each edge and/or on the face or back of the folder. The graphical elements will serve to impart an aesthetic appearance or bring attention to the expandable nature of the folder.

The invention thus provides a folder which is able to expand while retaining a flat appearance even when filled to capacity.

What is claimed is:

1. An expandable folder comprising a pair of sections having a fold line therebetween for folding of said sections into overlying relation to each other;

each said section including a front panel having a horizontally disposed score line spaced from a bottom edge thereof, a horizontally disposed score line spaced from a top edge thereof, a vertically disposed line spaced from one side edge thereof, a vertically disposed line spaced from a second side edge thereof and a plurality of angularly disposed score lines, each said angularly disposed score line extending from an intersection of a respective horizontally disposed score line and a vertically disposed score line to a respective corner of said panel; and each said section further including a second panel secured to said front panel thereof along a horizontal fold line therebetween and a vertical fold line therebetween to define an open pocket therewith, said second panel having a horizontally disposed score line spaced from a bottom edge thereof, a vertically disposed score line spaced from one side edge thereof and an angularly disposed score line extending from an intersection of said horizontally disposed score line and said vertically disposed score line to a corner of said second panel whereby upon insertion of materials into a respective pocket, said panels of a respective section expand away from each other to enlarge the thickness of the pocket while decreasing the width of the pocket.

2. An expandable folder as set forth in claim 1 wherein said second panel of each said section includes a side flap extending from and folded over said front panel thereof along said vertical fold line and a bottom flap extending from and folded over said front panel thereof along each horizontal fold line, said bottom flap being secured over said side flap.

3. An expandable folder as set forth in claim 2 wherein said side flap has said vertically disposed score line and said angularly disposed score line therein and wherein said bottom flap has said horizontally disposed score line therein.

4. An expandable folder as set forth in claim 2 wherein said side flap is of rectangular shape.

5. An expandable folder as set forth in claim 2 wherein said bottom flap extends from said vertically disposed score line in said side flap towards the opposite one of said sections.

6. An expandable folder as set forth in claim 1 wherein at least one of said sections is characterized in having shading between a score line and an adjacent edge to impart an aesthetic appearance thereto.

7. An expandable folder as set forth in claim 1 further comprising adhesive between a respective side flap and bottom flap for securing said side flap and bottom flap together.

8. An expandable folder as set forth in claim 1 wherein each said section is of rectangular shape with a variable height and a variable width and each score line is spaced at least ¼ inch from the adjacent edge thereof depending upon the requirements of the design.

9. A blank for forming an expandable folder comprising a first panel having a vertical fold line along a central line thereof to define a pair of front panels for folding over each other;

a pair of side flaps, each said side flap extending from a respective front panel along a vertical fold line therebetween for folding over a lower portion of said respective front panel; and a pair of bottom flaps, each bottom flap extending from a respective front panel along a horizontal fold line therebetween for folding over said respective front panel and a respective side flap thereon to define an opening pocket;

a plurality of score lines in each said front panel defining a rectangular frame, each said score line being spaced from a respective edge of said front panel;

a plurality of angularly disposed score lines in each said front panel, each angularly disposed score line extending from a corner of said frame to a corner of said front panel;

a vertical score line in each side flap in parallel spaced relation to said vertical fold line therein;

a horizontal score line in each bottom flap in parallel spaced relation to said horizontal score line; and an angularly disposed score line in each side flap extending from said vertical score line therein to said vertical fold line therein.

10. A blank as set forth in claim 9 wherein each said bottom flap is spaced from a vertical edge of said respective front panel.

* * * * *

UNITED STATES PATENT AND TRADEMARK OFFICE

CERTIFICATE OF CORRECTION

PATENT NO. : 6,116,651
DATED : September 12, 2000
INVENTOR(S) : Marvin A. Makofsky It is certified that error appears in the above-identified patent and that said Letters Patent is hereby corrected as shown below:

Delete Drawing Sheets 1-3 and substitute the attached drawings.

Signed and Sealed this

Eighteenth Day of April, 2006

JON W. DUDAS
*Director of the United States Patent and Trademark Office*

UNITED STATES PATENT AND TRADEMARK OFFICE

CERTIFICATE OF CORRECTION

PATENT NO. : 6,116,651
APPLICATION NO. : 09/506242
DATED : September 12, 2000
INVENTOR(S) : Marvin A. Makofsky It is certified that error appears in the above-identified patent and that said Letters Patent is hereby corrected as shown below:

Delete the title page and substitute therefor the attached title page.

Delete Drawing Sheets 1-3 and substitute the attached drawings.

This certificate supersedes Certificate of Correction issued April 18, 2006.

Signed and Sealed this

Eighth Day of August, 2006

JON W. DUDAS
*Director of the United States Patent and Trademark Office*

United States Patent [19]

Makofsky et al.

[11] Patent Number: 6,116,651

[45] Date of Patent: Sep. 12, 2000

[54] EXPANABLE FOLDER

[75] Inventors: Marvin A. Makofsky, Sand Point; Jerome B. Schwartz, Mineola, both of N.Y.

[73] Assignee: Pama Enterprises, New York, N.Y.

[21] Appl. No.: 09/506,242

[22] Filed: Feb. 17, 2000

[51] Int. Cl.[7] ..... B42D 3/00

[52] U.S. Cl. ..... 281/29; 281/31; 281/37; 281/45; 402/70; 402/73

[58] Field of Search ..... 281/29, 31, 37, 281/45, 51; 402/70, 73, 4; 493/947; 40/359; 206/425

[56] References Cited

U.S. PATENT DOCUMENTS

| | | | |
|---|---|---|---|
| 4,991,767 | 2/1991 | Wyant | 281/31 X |
| 5,025,978 | 6/1991 | Pacione | 281/29 |
| 5,174,606 | 12/1992 | Hune | 281/45 |
| 5,904,374 | 5/1999 | Lee | 281/29 |

*Primary Examiner*—Willmon Fridie, Jr.

*Attorney, Agent, or Firm*—Francis C. Hand, Esq.; Carella Byren Bain Gilfillan Cecchi Stewart & Olstein

[57] ABSTRACT

The folder is made with a pair of sections, each of which is provided with an inside panel to form a pocket. The inside panel and the front panel of each section of the folder is provided with vertical and horizontal score lines adjacent the respective edges of the folder to permit expansion of the pockets when filled with paper or the like. The folder is also provided with a pair of score lines on opposite sides of the vertical fold line to allow the folder to triangulate along the vertical fold line when the folder is filled to capacity. When filled to capacity, the folder retains a flat appearance.

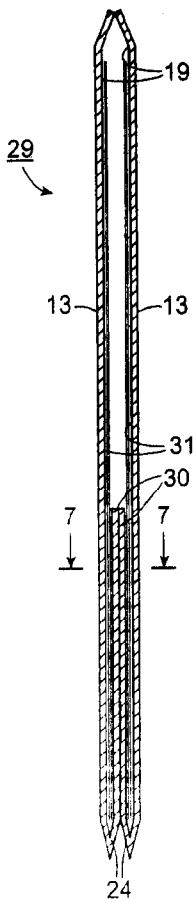

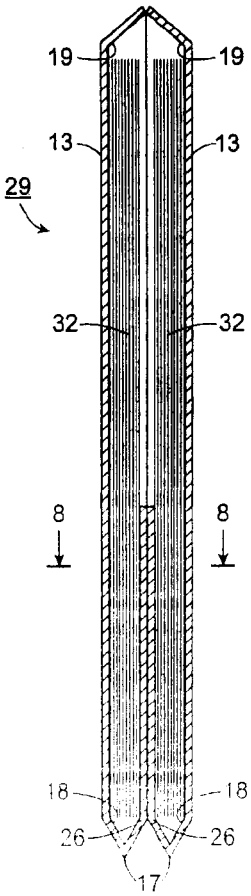

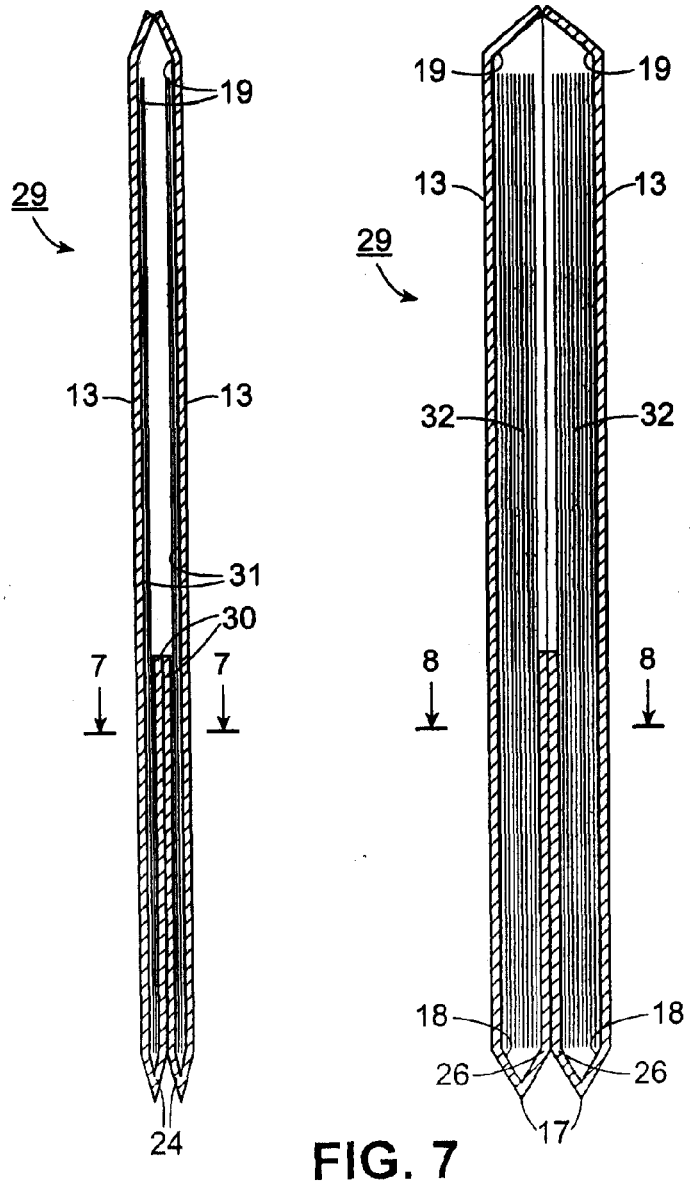
FIG. 7
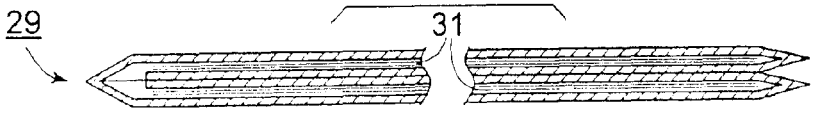
FIG. 8
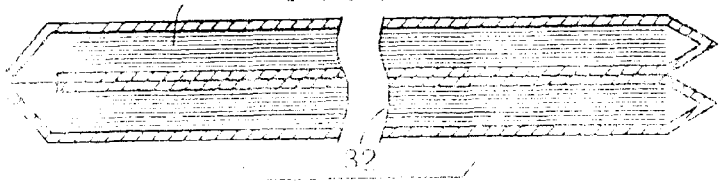

10 Claims, 3 Drawing Sheets